US005568750A

United States Patent [19]

Galen

[11] Patent Number: 5,568,750

[45] Date of Patent: Oct. 29, 1996

[54] LID LIFTER

[76] Inventor: Larry A. Galen, 37 Michelle La., St. Peters, Mo. 63376

[21] Appl. No.: 489,320

[22] Filed: Jun. 12, 1995

[51] Int. Cl.[6] ..... B67B 7/04

[52] U.S. Cl. ..... 81/3.49; 53/382.1

[58] Field of Search ..... 81/3.07, 3.09, 81/3.55, 3.47, 3.48, 3.49; 53/381.1, 382.1

[56] References Cited

U.S. PATENT DOCUMENTS

| | | | |
|---|---|---|---|
| 883,988 | 4/1908 | Vallandingham | 81/3.49 |
| 1,570,306 | 1/1926 | Johnson | 81/3.49 |
| 4,213,215 | 7/1980 | Hall | 81/3.47 |

*Primary Examiner*—D. S. Meislin

*Assistant Examiner*—Joni B. Danganan

*Attorney, Agent, or Firm*—Henry W. Cummings

[57] ABSTRACT

The tool 10 of the present invention includes in its mid-portion a handle or gripping portion 12. Extending outwardly in opposite directions from the gripping portion are a pair of spaced transition portions 14 and 16 each respectively terminating in a pair of tapered portions 18 and 19. The tapered portions 18 and 19 extend to a box engagement portion at each end 20 and 22. Each box engagement portion includes a transversely extending tapered portion 24 and 26 each of which terminates in a respective edge 28 and 29, and respective hook portions 30 and 32. It will be apparent that the transverse portion 20 is smaller than the transverse portion 22 to allow opening of smaller boxes with the end where transverse portion 20 is located.

9 Claims, 2 Drawing Sheets

LID LIFTER

FIELD OF THE INVENTION

This invention relates to a device and method for removing items, including, but not limited to, holiday ornaments from boxes, generally cardboard or plastic, to avoid harming the item or the box.

BACKGROUND OF THE INVENTION

U.S. Pat. No. 4,967,436 discloses a tool for removing container lids having a handle portion at one end and a lid gripping portion at the opposite end including a pocket for grasping a portion of the lid. However, this is effective for only one size lid and has an operative gripping portion at only one end.

In U.S. Pat. No. 4,173,909 a tool is disclosed having a handle portion and a tapered end portion for removing lids on containers having self-sealing reuseable lids. There is only one size of tool engagement portion and it is located at only one end of the tools.

U.S. Pat. No. 4,829,619 discloses a tool for removing tight fitting lids from bulk containers having a pair of lifting hooks at one end and a handle portion at the other. In this tool the lifting hooks are located at the same distal end from the handle portion.

In U.S. Pat. No. 5,222,265 a lid prying tool is disclosed having a handle at one end, a hook at the other end, and a pair of fulcrums to provide leverage for lifting. However, the lifting portion is at only one end of the device.

U.S. Pat. No. 4,747,173 discloses a tool for opening containers including a pair of laterally spaced opening hooks. At the distal end of the handle portion, a base portion is provided for engaging a portion of the lid to be removed. Opening hooks are only provided near the distal end from the handle portion.

Design U.S. Pat. No. 291,861 discloses a combination prying tool for can covers and a tool holder. However, in the operation of this device the base, which extends beyond the pair of lifters at each end, would interfere with the lifting operation insofar as an ornamental box is concerned.

OBJECTS OF THE INVENTION

One object of the present invention is to provide a tool for opening boxes containing items without harming the box or the ornament.

Another object of the present invention is to provide a tool for opening boxes containing items wherein the tool is adapted to open different size boxes.

Another object of the present invention is to provide a method for opening boxes containing items without harming the box or the item.

Other objects will be apparent from the following description and drawings.

THE DRAWINGS

FIG. 1 is a side elevation view of a tool in accordance with the present invention.

FIG. 1*a* is a detail view of a portion of FIG. 1 illustrating the locking lug angle.

SUMMARY OF THE INVENTION

Figure 2:
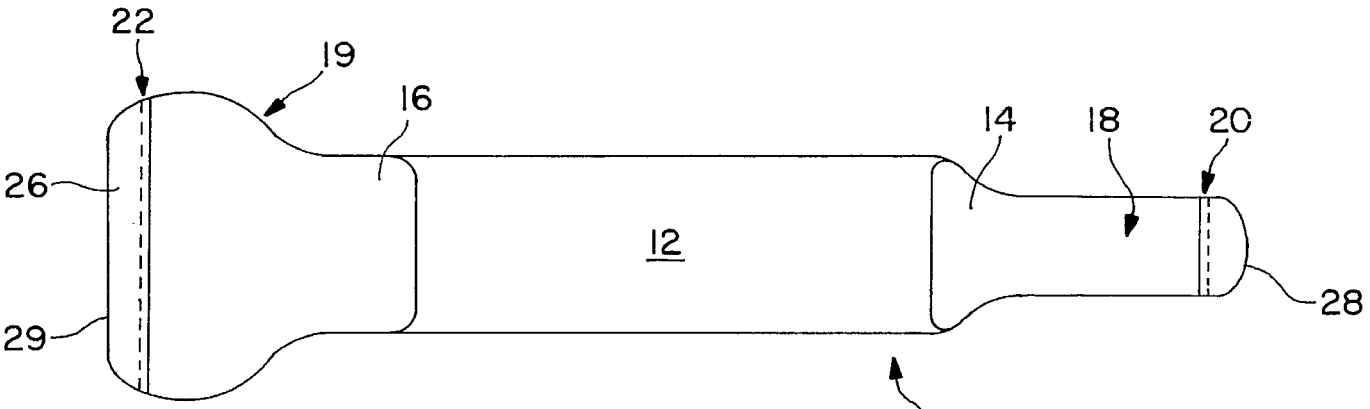
FIG. 2 is a plane view of a tool in accordance with the present invention.

The tool 10 of the present invention includes in its mid-portion a handle or gripping portion 12. Extending outwardly in opposite directions from the gripping portion are a pair of spaced transition portions 14 and 16 each respectively terminating in a pair of tapered portions 18 and 19. The tapered portions 18 and 19 extend to a box engagement portion at each end 20 and 22. Each box engagement portion includes a transversely extending tapered portion 24 and 26 each of which terminates in a respective edge 28 and 29, and respective hook portions 30 and 32. It will be apparent that the transverse portion 20 is smaller than the transverse portion 22 to allow opening of smaller boxes with the end where transverse portion 20 is located.

DESCRIPTION OF PREFERRED EMBODIMENTS

The tool of the present invention is indicated in the Drawings at 10.

The tool includes a body or gripping portion 12 located in the mid portion of the tool.

On each side of the gripping portion is a transition portion indicated respectively at 14 and 16. The transition portion is generally arcuate and terminates in a pair of tapered portions 18 and 19.

The tapered portions may conveniently have a thickness of about 1/32nd inch to 1/4 inch.

Each of the tapered portions are intergal with a pair of flap engagement portions, respectively indicated at 20 and 22.

Each of the flap engagement portions 20, 22 includes a second tapered portion 24, 26, which terminates in an entry edge 28, 29.

Figure 1A:
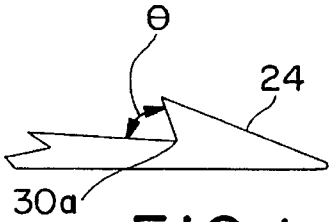
Figure 1:
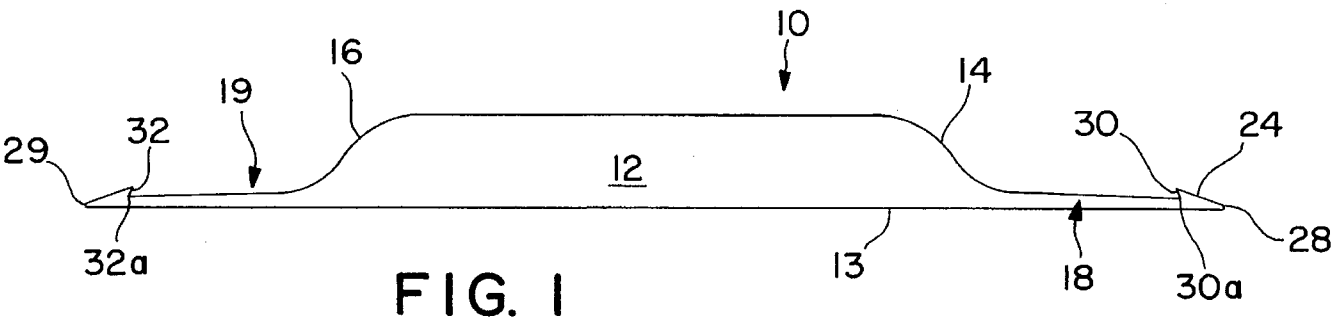

In addition a locking engagement projection, or lug 30, 32 is provided at each end, inboard of respective tapered portions 24 and 26. The locking lugs extend transversely, preferably the full width of the end portion. The locking lugs are formed by an arcuate portion having an angle $\Theta$ of at least about 80 degrees, up to about 160 degrees with the horizontal, through the base 30*a*, 32*a*, of the angular portion. See FIG. 1*a*. This angle is formed, for example by milling or grinding, or the flap engagement portions 20, 22, may be separate members welded or connected to the respective tapered portions 18 and 19 by welding or mechanical fasteners.

Preferably, the larger end portion 22, extends transversely from about 3/4ths of an inch to 2 & 1/2 inches.

Preferably, the smaller end portion 20 extends transversely from about 1/4th of an inch to about 3/4ths inches.

The tool may be made from a material selected from wood, plastic and metal.

Preferably, the tool is made of molded plastic.

Preferably, the transverse extent of the first tapered portions is from about 1/32nd inch to about 1/4th inch.

Preferably, the projections 30, 32, extend a total distance above said first tapered portion of at least 1/16 inch.

Figure 3:
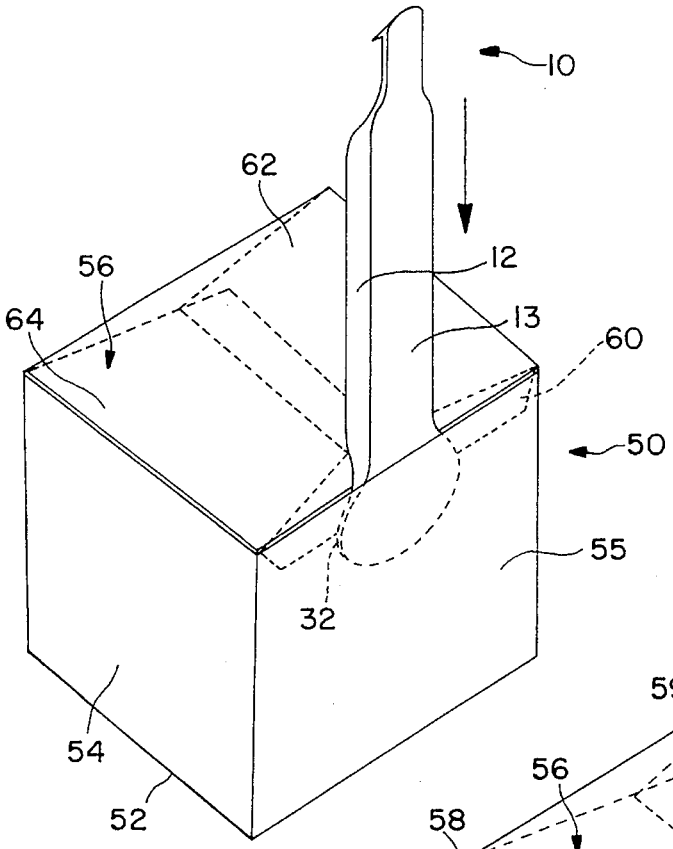
FIG. 3 is a perspective view of a box to be opened in accordance with the present invention showing the box in closed position.
Figure 4:
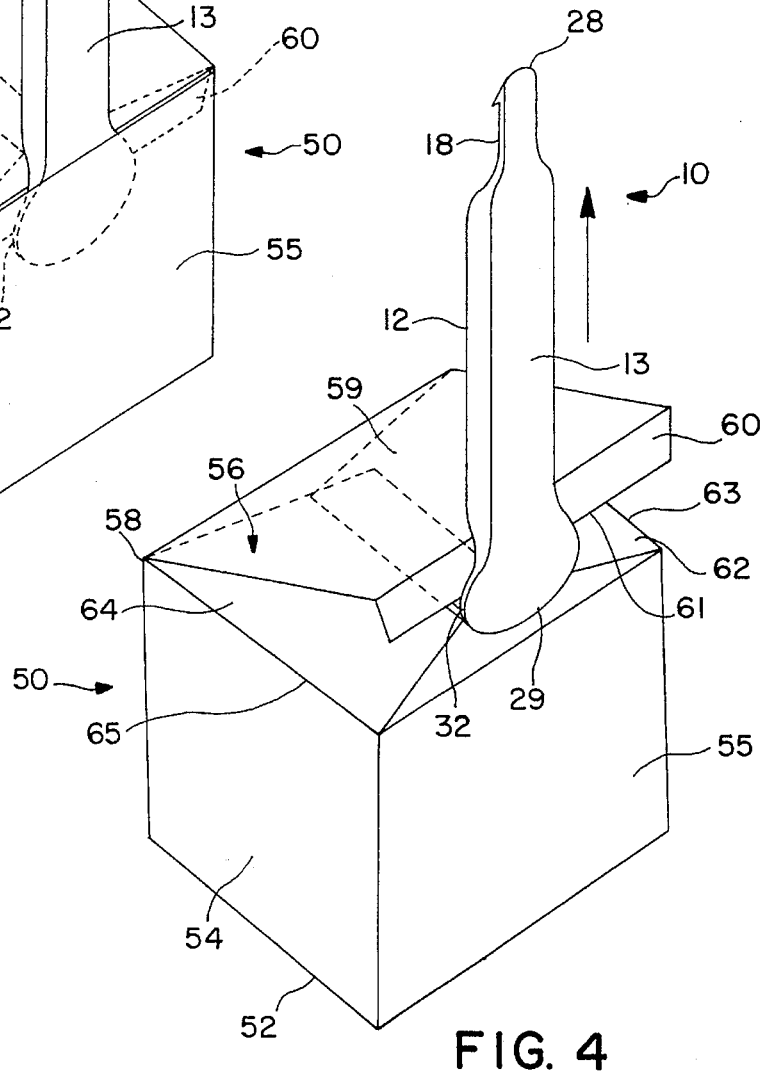
FIG. 4 is a view of the box in FIG. 3 being opened by the tool of the present invention.

The method of using the tool of present invention is illustrated in FIGS. 3 and 4. A box 50 containing fragile items such as holiday ornaments is illustrated, including a rectangular base 52, and rectangular walls 54. A lid indicated generally at 56 is pivoted at 58 and includes a top 59.

On each side of the box are additional top members 62 and 64 pivoted respectively at 63 and 65 folding upon themselves in closed position.

Top member 59 includes a generally vertical flap 60 extending downwardly to a lower edge 61.

As an example, FIG. 3 shows an ornamental box in closed position with the top members 62 and 64 folded upon one another and the top 56 located above them with the flap 60 extending downwardly parallel the wall 55.

In use the tool of the present invention is grasped by the handle portion 12 and one end of the tool, depending upon the size of the box, is located between the wall 55 and the flap 60. Entry into the box is facilitated by the edge 28 or 29 and then the tapered portion 24 or 26. The tool is lowered sufficiently far that the hook portion 30 or 32 engages the flap 60. The attendant will feel a give at that point. The attendant then raises the tool with the locking portion 30 or 32 in engagement with the flap and the external surface 13 slides along wall 55 until the flap exits the box.

It will be apparent that the entry edges 28 and 29 facilitate entry into the box without harming the box. The tapers 24 and 26 further facilitate this movement.

The use of end 20 or 22 depends upon whether a larger or smaller box is to be opened. If a smaller box is to be opened, end 20 is preferred because less transverse engagement between tapered portion 24 and flap 60 is required. It further is to be noted that edge 28 is more arcuate than is edge 29.

End 22 is utilized for larger boxes wherein more contact is required between tapered portion 26 and flap 60.

What is claimed is:

1. A tool for opening boxes containing items comprising:

a handle or gripping portion located at the mid portion of the tool;

a transition portion extending outwardly and downwardly on each side of said gripping portion from said gripping portion;

a box engagement portion extending outwardly from each of said transition portions and each box engagement portion having a transverse extent;

said box engagement portion terminating at a distal end of each end of the tool;

a locking portion extending upwardly from each said box engagement portion;

said locking portion being adapted to engage downwardly extending lids of said boxes;

the transverse extent of one of said box engagement portions being significantly greater than the transverse extent of the other box engagement portion to define a larger end portion and a smaller end portion to enable the tool to be used to open different sized boxes.

2. A tool according to claim 1 wherein the larger end portion extends transversely from about ¾ths of an inch to 2½ inches.

3. A tool according to claim 2 wherein the smaller end portion extends transversely from about ¼th of an inch to about ¾ths inches.

4. A tool according to claim 1 wherein said tool is made from a material selected from wood, plastic and metal.

5. A claim according to claim 4 wherein said tool is made of plastic.

6. A tool according to claim 5 wherein said tool is made of molded plastic.

7. A tool according to claim 1 wherein each of said transition portions merges with a tapered portion having a transverse extent of from about 1/32 to ¼ inch.

8. A tool according to claim 7 wherein said locking portion extends a total distance above said box engagement portion of at least 1/16 inches.

9. A tool for opening boxes containing items comprising:

a handle or gripping portion located at the mid portion of the tool;

a transition portion extending outwardly and downwardly on each side of said gripping portion from said gripping portion;

a tapered portion extending outwardly and downwardly from each of said transition portions;

a box engagement portion extending outwardly from each of said tapered portions, and each box engagement portion having a transverse extent;

each box engagement portion terminating at a distal end of each end of the tool;

a locking portion extending upwardly from each said box engagement portion;

said locking portion being adapted to engage downwardly extending lids of said boxes;

the transverse extent of one of said box engagement portions being significantly greater than the transverse extent of the other box engagement portion to define a larger end portion and a smaller end portion to enable the tool to be used to open different sized boxes.

* * * * *